US005272848A

United States Patent [19]

Maas

[11] Patent Number: 5,272,848

[45] Date of Patent: Dec. 28, 1993

[54] PORTABLE ROOM DIVIDER

[76] Inventor: Paul Maas, 1387 Woodland La., Riverwoods, Ill. 60015

[21] Appl. No.: 839,532

[22] Filed: Feb. 20, 1992

[51] Int. Cl.[5] ..... E04B 2/74

[52] U.S. Cl. ..... 52/238.1; 160/135

[58] Field of Search ..... 160/135; 52/238.1, 239, 52/71

[56] References Cited

U.S. PATENT DOCUMENTS

| | | | |
|---|---|---|---|
| D. 323,944 | 2/1992 | Maas | 312/198 |
| 668,748 | 2/1901 | Buchanan | 160/135 |
| 756,091 | 3/1904 | Altick | 312/297 |
| 1,410,225 | 3/1922 | Seaman | 52/239 |
| 1,731,321 | 10/1929 | Terrisse | 52/71 |
| 2,162,523 | 6/1939 | Blood et al. | 52/71 |
| 3,017,969 | 1/1962 | Nielsen | 160/351 |
| 3,060,521 | 10/1962 | Greco | 52/243 |
| 3,330,611 | 7/1967 | Heifetz | 312/297 |
| 3,387,413 | 6/1968 | Huey | 52/69 |
| 3,402,515 | 9/1968 | Rainaut | 52/64 |
| 3,534,512 | 10/1970 | Ballas | 52/67 |
| 3,565,152 | 2/1971 | Cohn, Jr. | 160/135 |
| 3,629,982 | 12/1971 | Ballay | 52/69 |
| 3,674,081 | 7/1972 | List | 160/161 |
| 3,677,322 | 7/1972 | Brorson et al. | 160/135 |
| 3,866,365 | 2/1975 | Honigman | 52/70 |
| 4,161,850 | 7/1979 | Peterson et al. | 52/65 |
| 4,192,106 | 3/1980 | Hell | 52/36 |
| 4,569,163 | 2/1986 | Long | 52/36 |
| 4,932,172 | 6/1990 | Maas | 52/71 |

FOREIGN PATENT DOCUMENTS

| | | | |
|---|---|---|---|
| 420320 | 7/1937 | United Kingdom | 160/135 |
| 498323 | 1/1939 | United Kingdom | 160/135 |

*Primary Examiner*—Janes L. Ridgill, Jr.
*Attorney, Agent, or Firm*—Quarles & Brady

[57] ABSTRACT

A portable room divider includes a plurality of folded wall panels positioned between a pair of end members with wheels. The end members are provided with clasps that normally retain the panels in a folded condition and cooperate with the end members to form a cart for the panels. The clasps can be disengaged to permit the panels to be unfolded to form a wall that is anchored at each end by an end member.

7 Claims, 2 Drawing Sheets 10
11
11a
11b
11'
12a
12b
13
14
15
16
17
18
19
20
21

PORTABLE ROOM DIVIDER

FIELD OF THE INVENTION

The present invention relates generally to room dividers, more particularly, it relates to a portable, freestanding room divider.

BACKGROUND OF THE INVENTION

There are times that it is desired to divide large areas, such as rooms or halls, into smaller more private areas. One method of doing this is by the use of movable wall panels which are suspended from and move on tracks attached to the ceiling and/or floor. This method is relatively expensive and it is inflexible.

Another method of dividing large areas into smaller private areas is to use movable freestanding walls. This method is relatively inexpensive and it permits the formation of areas of a wide variety of shapes, but the presently available freestanding walls present storage and handling problems.

There is a need for a portable, freestanding room divider for dividing large areas into a wide variety of different shaped smaller and more private areas which does not present storage and handling problems.

BRIEF SUMMARY OF THE INVENTION

It is an object of the present invention to disclose an inexpensive, portable, freestanding room divider for dividing large areas into smaller private areas.

It is a further object to disclose a portable, freestanding room divider which does not present the storage and handling problems of prior art freestanding wall units.

The apparatus of the present invention comprises a plurality of hinged and folded wall panels which can be unfolded to form a wall, a first end member with wheels attached to the first wall panel; a second end member with wheels attached to the last wall panel and means for joining the panels and first and second end members together to keep the panels folded and to form a cart for moving the folding wall panels to a place of use.

In a preferred embodiment, the wall panels are mounted on casters and the means for joining the panels and first and second end members to form a cart is a clasp on each of the end members which keeps the panels folded and which can be disengaged to permit the panels to be unfolded to form a wall.

It will be apparent to those skilled in the art from the description that follows that the aforementioned and other objects can be achieved by the apparatus of the present invention.

DESCRIPTION OF THE PREFERRED EMBODIMENT

Figures 1, 2, 6:
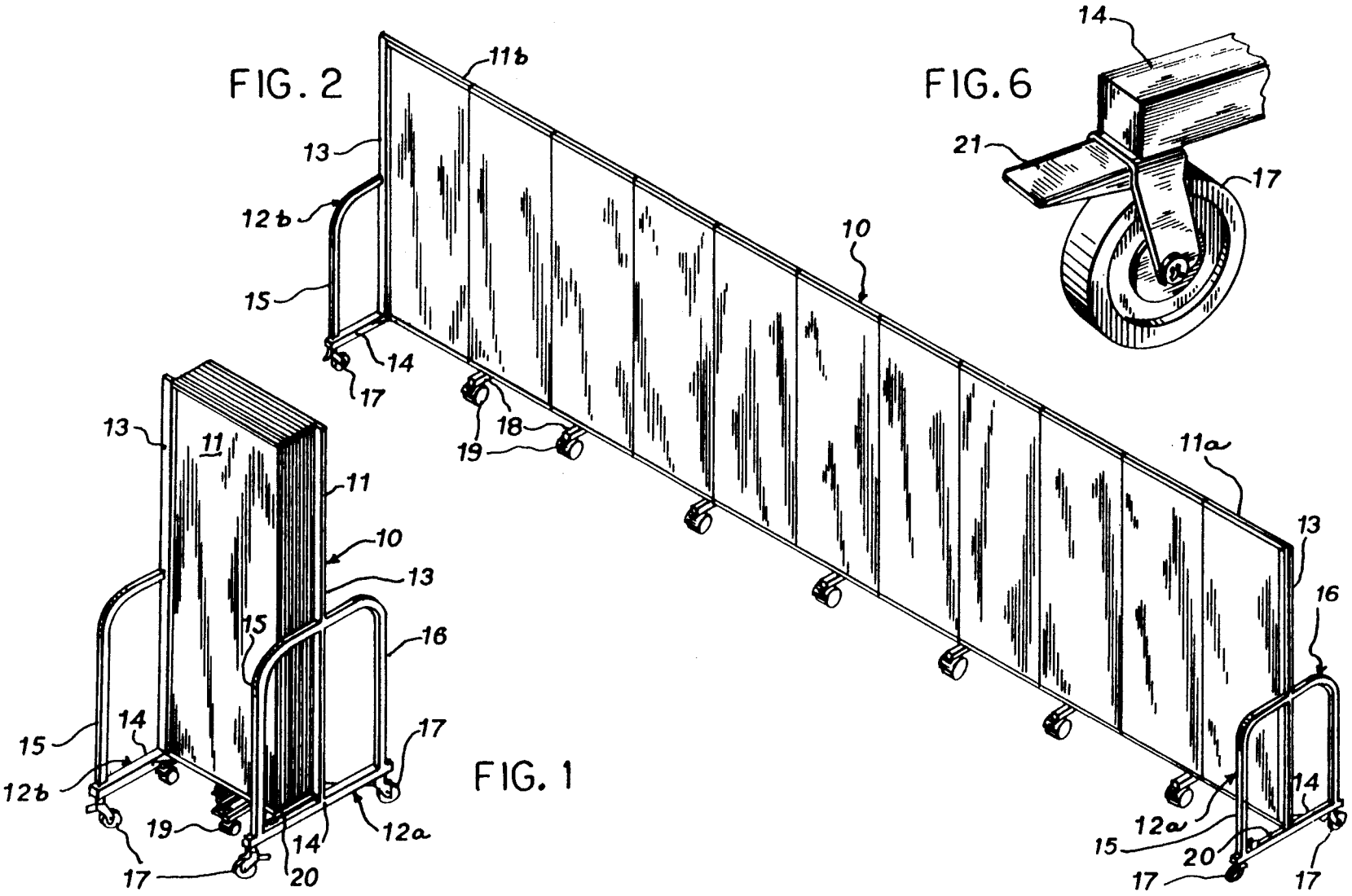
FIG. 1 is a perspective view of the preferred embodiment of the portable, freestanding, room divider of the present invention with the panels folded.
FIG. 2 is a perspective view of the embodiment of FIG. 1 with the wall panels unfolded to form a straight wall.
FIG. 6 is an enlarged, partial view showing a wheel with a brake.

In the drawings FIGS. 1 to 6 show a preferred embodiment of the present invention.

Figure 3:
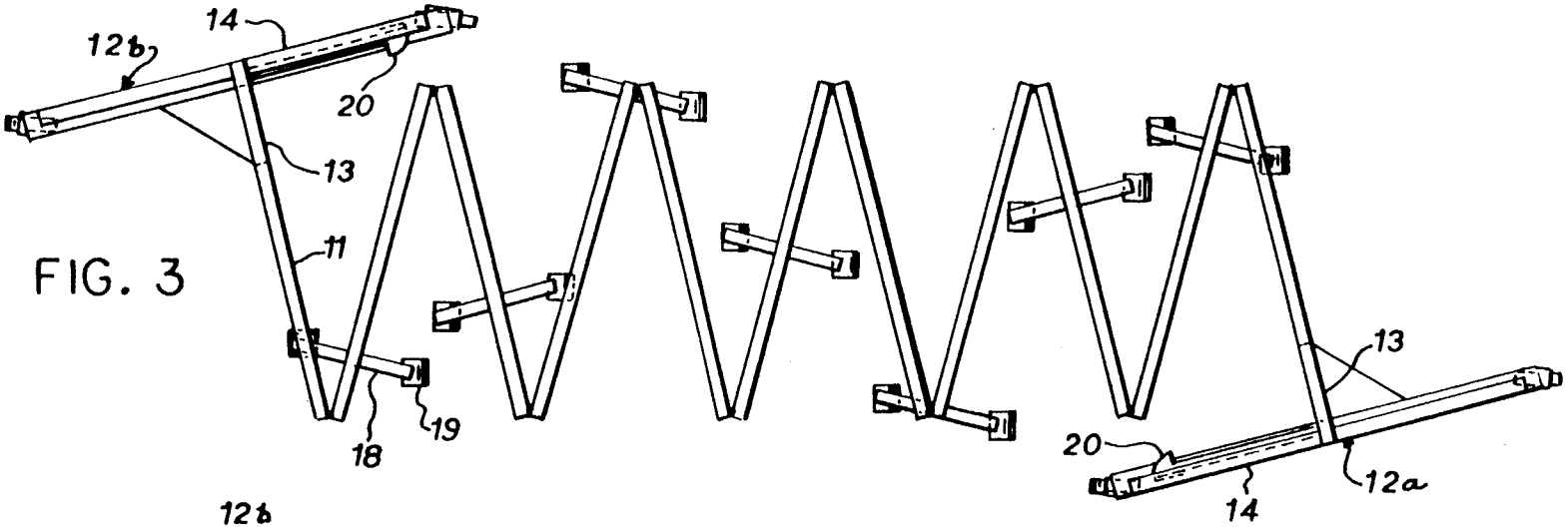
FIG. 3 is a top view of the embodiment of FIG. 1 partially unfolded.

In FIG. 1, the room divider 10 is shown prior to use as a room divider and in FIG. 2 it is shown in use with the wall panels 11 unfolded. In FIG. 3 the room divider 10 is shown with the wall panels 11 partially unfolded as they might be prior to complete folding or unfolding.

Still referring to FIGS. 1 and 2, it can be seen that the first and last panels 11*a* and 11*b*, respectively, are attached to end members 12*a* and 12*b*, respectively. The end members 12*a* and 12*b* have a vertical post 13 to which a panel 11 can be attached, a horizontal base bar 14 and a pair of curved posts 15 and 16 connecting the base bar 14 to the vertical post 13. The end members 12*a* and 12*b* are wider than the panels 11 and provide support for the unfolded panels 11. The curved posts 15 and 16 provide convenient handles for moving the room divider 10. The base bar 14 of the end members 12*a* and 12*b* is provided with wheels 17 so that the room divider 10 is portable and can be easily moved from one location to another.

Figure 4:
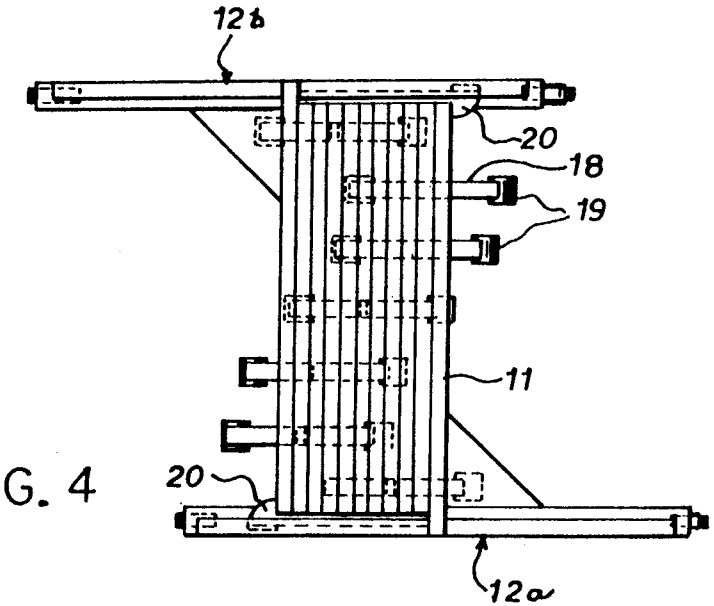
FIG. 4 is a top view of the embodiment as seen in FIG. 1.

In FIGS. 2, 3 and 4 it can be seen that some of the wall panels 11 are provided at the bottom with a foot 18 having a pair of spaced-apart floor engaging multidirectional casters 19. The foot 18 and casters 19 help support the wall when it is assembled.

Turning to FIG. 3, it is apparent that the wall panels 11 are connected to immediately adjacent panel(s) by hinges (not shown) so that the panels can be readily folded for storage as seen in FIG. 1 or unfolded to form a wall as seen in FIG. 2.

Figure 5:
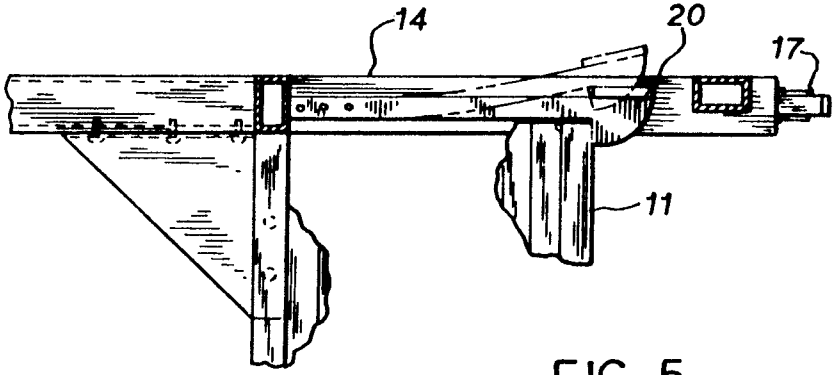
FIG. 5 is an enlarged, partial view showing a clasp on an end member.

In FIG. 5, the preferred means for forming a cart from the folded panels 11 and the end members 12*a* and 12*b* to permit the room divider 10 to be moved to a place of use is seen to be a clasp 20 which is a flexible L-shaped bar attached at one end to the base bar 14 of an end member 12. The clasp 20 as shown in solid lines normally retains the panels 11 in folded condition; however, the clasp 20 can be readily disengaged by manually flexing it outwardly as shown in dotted lines to permit the panels 11 to be unfolded. Each of the end members 12*a* and 12*b* has a clasp 20 and when the clasps 20 are in the position shown in solid lines a cart is formed which permits the room divider 10 to be readily removed.

In use, the room divider 10 as seen in FIG. 1 is readily moved into an area to be divided. The room divider 10 is positioned where desired to divide the area into one or more predetermined private areas. The clasps 20 on the end members 12*a* and 12*b* are then flexed outwardly and the panels 11 unfolded to form a wall of the desired shape. The wheels 17 on the end members 12*a* and 12*b* are then locked in place with brakes 21 (seen best in FIG. 6) to anchor the ends of the wall. If desired, the casters 19 on the panels also can be provided with brakes to help immobilize the thus formed wall.

When it is desired to disassemble the wall and store the wall panels 11, the brakes, if any, on the casters 19, and the brakes 21 on the wheels 17 of the first and second end members 12*a*, 12*b* are unlocked and the hinged panels 11 folded and the clasps 20 used to retain the panels 11 folded as seen in FIG. 1.

It will be apparent to those skilled in the art from the foregoing description and the drawings that the present invention provides a very convenient, inexpensive and flexible means for dividing large areas into smaller more private areas. The walls that are formed can be straight, angular or partially folded. The walls can be the width of a single wall panel or any multiple thereof and within limits they can extend in any direction.

It also will be apparent to those skilled in the art that a number of changes and modifications can be made without departing from the spirit and scope of the invention. For example, the end members, clasps, wall panels, wheels, and casters may take forms other than those shown and described. Therefore, it is intended that the invention not be limited except by the claims.

I claim:

1. A freestanding room divider comprising (a) a first non-panel end member with wheels;

(b) a second non-panel end member with wheels;

(c) a plurality of hinged wall panels, a first of said panels being connected at one side to the first end member at a point intermediate the width of said first end member and the last of said panels being connected at one end to the second end member at a point intermediate the width of said second end member so that said panels can be unfolded to form a wall anchored at one end by the first end member and at the other end by the second end member with each of the end members in a different plane than the plane of the panel to which it is attached so that the end members lend lateral stability to the wall; and (d) means for joining the folded panels and the end members together to form a cart which permits the room divider to be readily moved.

2. A portable room divider of claim 1 in which at least one of the wall panels is mounted on casters.

3. A portable room divider of claim 1 in which the wheels on the end members are provided with brakes.

4. A portable room divider of claim 1 in which the means for joining the folded panels and end members are clasps mounted on the end members.

5. A portable room divider of claim 1 in which the end members include handle portions for facilitating the movement of the room divider.

6. A freestanding room divider comprising (a) an inverted T-shaped first end member having a vertical stem and a horizontal base with wheels;

(b) an inverted T-shaped second end member having a vertical stem and a horizontal base with wheels;

(c) a plurality of hinged wall panels, a first of said panels being connected at one side to the stem of the first end member and a last of said panels being connected at one end to the stem of the second end member so that when said panels are unfolded to form a wall anchored at one end by the first end member and at the other end by the second end member the horizontal bases of each of said end members are generally perpendicular to the panel to which the end member is attached; and (d) means for joining the end members together to form a cart which permits the room divider to be readily moved.

7. A freestanding room divider comprising (a) a plurality of hinged wall panels;

(b) a first end member having a rod-like vertical upright and a horizontal base with wheels; and (c) a second end member having a rod-like vertical upright and a horizontal base with wheels;

the upright of said first end member being connected to one end of a first panel and the upright of the second end member being connected to one end to a last panel so that when said panels are unfolded to form a wall anchored at one end by the first end member and at the other end by the second end member, the horizontal bases of each of the end members is generally perpendicular to the panel to which it is attached so that the end members lend lateral stability to the wall.

* * * * *